United States Patent [19]

Honkajärvi et al.

[11] Patent Number: 4,785,878

[45] Date of Patent: Nov. 22, 1988

[54] DOUBLE-SPIRAL HEAT EXCHANGER

[75] Inventors: Markku V. Honkajärvi; Tero T. Tiitola, both of Pori, Finland

[73] Assignee: Outokumpu Oy, Helsinki, Finland

[21] Appl. No.: 916,619

[22] Filed: Oct. 8, 1986

[30] Foreign Application Priority Data

Oct. 14, 1985 [FI] Finland ..... 853990

[51] Int. Cl.[4] ..... F28D 7/02

[52] U.S. Cl. ..... 165/163; 165/164

[58] Field of Search ..... 165/164, 163, 165

[56] References Cited

U.S. PATENT DOCUMENTS

| | | | |
|---|---|---|---|
| 1,799,081 | 3/1931 | Blomquist | 165/164 |
| 1,989,772 | 2/1935 | Robinson | 165/164 X |
| 2,653,014 | 9/1953 | Sniader | 165/164 X |
| 3,854,530 | 12/1974 | Jovet et al. | 165/164 X |
| 4,287,724 | 9/1981 | Clark | 165/163 X |
| 4,306,618 | 12/1981 | Honkajärvi | 165/165 X |
| 4,380,912 | 4/1983 | Edwards | 165/154 X |
| 4,479,533 | 10/1984 | Persson et al. | 165/163 X |
| 4,602,674 | 7/1986 | Eriksson | 165/70 |

FOREIGN PATENT DOCUMENTS

| | | | |
|---|---|---|---|
| 1163792 | 3/1984 | Canada . | |
| 1185961 | 4/1985 | Canada . | |
| 123424 | of 1967 | Czechoslovakia | 165/163 |
| 1404208 | 8/1958 | Fed. Rep. of Germany | 165/163 |
| 2360257 | 6/1975 | Fed. Rep. of Germany | 165/164 |
| 422848 | 4/1967 | Switzerland | 165/164 |
| 334333 | 9/1930 | United Kingdom | 165/164 |
| 2570 | 1/1931 | United Kingdom | 165/164 |
| 938372 | 10/1963 | United Kingdom | 165/164 |

*Primary Examiner*—Ira S. Lazarus
*Assistant Examiner*—Richard R. Cole
*Attorney, Agent, or Firm*—Dellett, Smith-Hill and Bedell

[57] ABSTRACT

A spiral heat exchanger composed of two separate pipe systems, wherein each heat exchange medium runs in its own pipe system. The heat-emitting and the heat-absorbing pipe sytems are arranged in a tight, intermeshing fashion, in order to improve the heat exchange between the separate spirals, these are interconnected by employing a medium metal. The medium metal is applied by soldering, by dipping the heat exchanger into molten metal or by casting the molten metal on top of the exchanger.

3 Claims, 1 Drawing Sheet

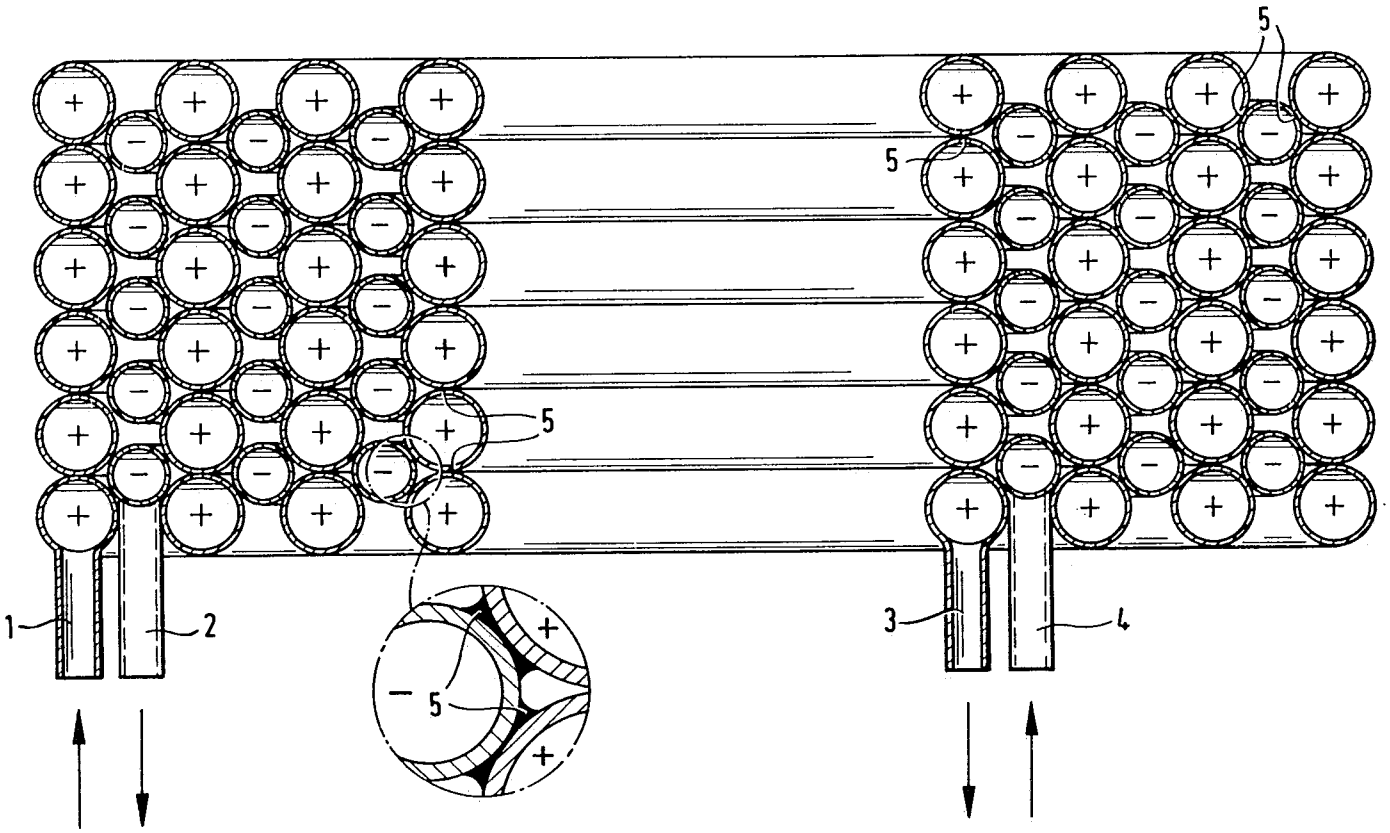
1
2
3
4
5
5
5
5

DOUBLE-SPIRAL HEAT EXCHANGER

The present invention relates to a double-spiral heat exchanger which is formed of two separate pipe systems so that each heat exchange medium runs in its own pipe system. The spirals of the two pipeworks are closely intermeshed, and a metallic contact between the spirals is created by means of a medium metal.

In the prior art there is known for instance the spiral heat exchanger introduced in the Finnish Patent Application No. 822007, wherein the pipes pertaining to separate heat networks are interchanged within one cycle in the cross-sectional plane of the spiral axis. The circles of the spirals are pressed against each other, so that the contact surface between the circles is enlarged, and the heat exchange thus improved. The purpose is that the pipes are always exactly matched on top of each other, and that during winding, the pipes are pressed so that they become elliptical in cross-section. The said heat exchanger is employed mainly as a tertiary heat exchanger, so that the whole pipework is closed inside a tank, where a third liquid flows around the pipework. The application text says that there is a metallic contact between the pipes, but what is in question here is in fact only a mechanical contact between two metal pipes, because the text does not mention any kind of thermal treatment, and a metallic contact between two pipes cannot be created by pressing only. In the said heat exchanger, the proportion of the empty space between the pipes is considerable, but if the apparatus is used as a tertiary heat exchanger, the surrounding third liquid fills up the empty space.

The fitting of flattened pipes in an intermeshing fashion in a heat exchanger is a technique already introduced in the Finnish Patent Application 830419. The pipes are non-round in cross-section, so that their flanks are at least partly planar and possibly provided with additional fins or the like. The spirals formed by the pipes are not self-supporting, but they are placed between two plates.

The U.S. Pat. No. 4,306,618 specifies a spiral pipe bundle of a heat exchanger, where the spiral pipe bundle is surrounded by an external sheath (pressure vessel). Thus there is one liquid flowing in the pipes of the spiral pipe bundle, and another liquid flowing outside the pipe bundle, within the sheath, in which case a good contact between the pipes is not essential for the heat exchange, but -because the wall formed by the pipes guides the circulation of the sheath water, - a contact between the pipes is necessary. Consequently it has been tried to make the contact as slight as possible, e.g. linear-like, so that as much as possible of the valuable surface effective for heat exchange should remain directed outward; therefore the pipes are made, in a high temperature, to be welded to each other. The strength of the wall formed by the pipes is further improved by applying a solder agent in between the pipes.

The international application No. WO81/03300 introduces a method for manufacturing a double heat exchanger by forming a transversal pipe wall of two separate pipes, in which wall every second pipe belongs to one system, and every second to another system. A heat-conducting mass is squeezed on the outer surface of this pipe wall, whereafter another pipe spiral layer is wound around the pipe spirals in similar fashion, but intermeshed with respect to the previous layer. Several layers, seen in the horizontal plane, can be applied on top of each other, and each layer is covered with heat-conducting mass, which is pressed in between the pipes while the next layer of spiral pipes is wound on top of the previous one. The diameter of the pipes in one transversal plane is always the same, but in the outer spiral rows, the pipe diameter can grow.

The invention of the present application is related to a double-spiral heat exchanger which is formed of the intermeshed pipe spirals of two separate pipe systems, between which spirals there is created a metallic contact by aid of some medium metal. The essential novel features of the invention are apparent from the patent claim 1.

According to the invention, the aim is to realize a pressure-proof double spiral heat exchanger composed of pipes only, where a separate external pressure vessel is not needed. Another essential feature of the heat exchanger is that the pipe spirals belonging to different pipe systems are placed as near to each other as possible, and a good heat transfer is further secured by aid of a medium metal, so that a metallic contact is created between the pipes.

The structure of a heat exchanger embodying the invention is described in more detail with reference to the appended drawing, where the single FIGURE is a schematical illustration of the heat exchanger, seen in cross-section.

In the FIGURE, the pipes of the two separate pipe systems are marked with the symbols + and −. Into the pipe system marked with +, the liquid enters via the inlet connection 1, and as is apparent from the drawing, the outlet connection 3 of the pipe system is located in the middle part of the heat exchanger. Inside the second pipe system marked with the symbol −, the liquid flows in the opposite direction, so that the outlet connection 2 of the pipe system—is located on the outer circumference of the exchanger, and the inlet connection 4 is located in the middle part of the exchanger. A metallic contact between the pipes is created by aid of the medium metal 5.

The double spiral heat exchanger is manufactured by starting with essentially round copper or copper alloy pipes which are bent to form regular spirals in the horizontal plane. The pitch per each cycle is constant and depends on the pipe diameter. In the most advantageous method for manufacturing these double spiral heat exchangers, the pipe spirals are located compactly on top of each other so that the pipes of the separate pipe systems become closely intermeshed, i.e. the spirals of separate systems are placed in turns on top of each other, as is seen in the FIGURE, and the ends of the pipes belonging to the same pipe system are connected, by suitable means, to be coupled to the respective inlet and outlet connections. The diameter of the pipes of separate pipe systems can be the same, or it can differ between the two systems, as is the case in the FIGURE.

The double spiral heat exchanger can also be manufactured so that the spirals of each the two pipe systems are first combined to form a whole wall of pipe bundle, whereafter the separate pipe bundle walls are pressed against each other so that they become intermeshed.

In the double spiral heat exchanger manufactured in the above described fashion, the contact between the pipes is a linear-like contact. Now the aim is to improve the said contact by employing a medium metal, so that the contact surface between the pipes is enlarged. As was already pointed out, medium metal has been used to some extent in the prior art in order to make a uniform wall of the pipes, but there the purpose has not been to improve the heat exchange, because one and the same liquid has been flowing in all pipes, but only in order to achieve a uniform wall. In the experiments which were carried out it has now been proved that the thermal exchange capacity between the pipes can be increased to be multiple as compared to the mechanical contact, if a metallic contact is created between the pipes by aid of a medium metal. The increase in the thermal exchange capacity, achieved by means of the medium metal, is also remarkably greater than the increase achieved by means of heat-conducting masses.

The employed medium metal can be for instance tin, zinc, lead, aluminium or an alloy of these. The metallic contact is created for example by means of soldering, dipping or casting, in which case also the small, line-like grooves are filled owing to the capillary forces. Thus it is possible to insert some soldering medium in between the spirals of the double spiral heat exchanger, which soldering medium melts during the annealing of the exchanger, and thus forms a uniform surface, remarkably larger than in the linear contact, in between the pipes. The exchanger can also be dipped into a molten metal, for example zinc. In connection to the dipping, the pipes are also soft-annealed, so that the tensions in the structure can be eliminated while the structure is recrystallized. Instead of the dipping, some suitable metal can be cast on the exchanger. The cast metal on top of the pipes improves the mechanical protection considerably, in which case the pipe wall can be left thinner.

As was mentioned above, the heat exchanger is formed of round pipes, which have a tenfold pressure endurance compared to moulded, for instance flattened pipes. Thus round pipes can be used for forming a double spiral heat exchanger where an external pressure vessel is not needed, but where each heat exchange medium runs in its own pipe system. For example with freon equipment it is absolutely necessary that the freon cannot, even if the pipes are broken, be discharged into the water. In the double spiral heat exchanger this can be prevented, because in case of a leakage, the liquid is discharged into the space in between the pipes, where it can be observed by various different methods.

EXAMPLE

The increase in the thermal exchange capacity, achieved by aid of the medium metal, can be described with reference to the appended experimental results:

TABLE 1

| Contact between the pipes | Coefficient of thermal transmittance = k[W/m$^2$K] |
|---|---|
| Mechanical contact | 300 |
| Tin soldering | 700 |
| Zinc dipping | 1100 |
| Zinc casting | 1150 |

The coefficient of thermal transmittance of a heat-conducting mass is not included in the table, but it is located between mechanical contact and thin soldering.

What is claimed:

1. A heat exchanger comprising two distinct pipe systems each defining an interior space, the interior spaces of the two pipe systems being mutually isolated with respect to fluid communication, and each pipe system comprising a plurality of pipes that are circular in cross-section and are formed into respective flat coils each defining a general plane and having a central axis, the flat coils being arranged with their general planes substantially parallel to each other and with their central axes being substantially coincident and with at least one flat coil of each pipe system being disposed between and in intermeshing relationship with two flat coils of the other pipe system, whereby a thermally-conductive metallic contact is created between the two pipe systems.

2. A heat exchanger according to claim 1 comprising a medium metal which is metallurgically bonded to the coils of the two pipe systems and provides the metallic contact between the coils of the two pipe systems.

3. A heat exchanger according to claim 2, wherein the medium metal is a metal selected from the group consisting of tin, alloys of tin, zinc, alloys of zinc, lead, alloys of lead, aluminum and alloys of aluminum.

* * * * *